US012779317B2

(12) United States Patent
Schnee

(10) Patent No.: US 12,779,317 B2
(45) Date of Patent: Nov. 3, 2026

(54) BOARD GAME FOR VISUALLY IMPAIRED USERS

(71) Applicant: Brian Schnee, Rockville Centre, NY (US)

(72) Inventor: Brian Schnee, Rockville Centre, NY (US)

( * ) Notice: Subject to any disclaimer, the term of this patent is extended or adjusted under 35 U.S.C. 154(b) by 454 days.

(21) Appl. No.: 18/532,605

(22) Filed: Dec. 7, 2023

(65) Prior Publication Data

US 2025/0186872 A1 Jun. 12, 2025

(51) Int. Cl.
*A63F 3/00* (2006.01)

(52) U.S. Cl.
CPC ..... *A63F 3/00574* (2013.01); *A63F 3/00697* (2013.01); *A63F 2003/00583* (2013.01); *A63F 2003/00835* (2013.01)

(58) Field of Classification Search
CPC .. A63F 2003/00583; A63F 2003/00586; A63F 2003/00593
See application file for complete search history.

(56) References Cited

U.S. PATENT DOCUMENTS 2,053,598 A * 9/1936 Blau ..... A63F 3/00075 273/285
8,454,022 B1 * 6/2013 Zou ..... A63F 3/0415 273/287

FOREIGN PATENT DOCUMENTS

GB 2392849 A * 3/2004 ..... A63F 3/00574

* cited by examiner

*Primary Examiner* — Brian O Peters
(74) *Attorney, Agent, or Firm* — Dunlap Bennett & Ludwig PLLC

(57) ABSTRACT

A board game includes a base having a top surface and a bottom surface. The board game further includes a predefined count of first sections disposed on the top surface. Each first section includes a predefined count of second sections, and each second section includes a hole. The board game further includes a predefined count of insert members having a first portion and a second portion. A plane of the first portion is perpendicular to a longitudinal axis of the second portion. Further, the predefined count of insert members is equal to a total count of second sections in the base. Furthermore, the second portion includes a protrusion configured to be removably inserted into the hole.

10 Claims, 3 Drawing Sheets

BOARD GAME FOR VISUALLY IMPAIRED USERS

BACKGROUND

Field

The present disclosure generally relates to a board game, and more particularly to a board game that enables visually impaired users to conveniently play.

Description of the Related Art

Many people play board boards for recreational purposes. It is known that visually impaired people find it difficult to play conventional board games, as the conventional board games are small in size, and use game pieces that are not easily distinguishable from each other.

Therefore, a board game is required that is convenient for the visually impaired people to play.

SUMMARY

The following presents a simplified summary of the present disclosure in a simplified form as a prelude to the more detailed description that is presented herein.

In accordance with aspects of the disclosure, a board game includes a base including a top surface and a bottom surface and a predefined count of first sections disposed on the top surface. Each first section comprises a predefined count of second sections, and each second section comprises a hole. The base includes a predefined count of insert members. Each insert member includes a first portion and a second portion, and a plane of the first portion is perpendicular to a longitudinal axis of the second portion. The predefined count of insert members is equal to a total count of second sections in the base. The second portion comprises a protrusion configured to be removably inserted into the hole.

In accordance with additional aspects of the disclosure, a board game includes a base including a top surface and a bottom surface and a predefined count of first sections disposed on the top surface. Each first section comprises a predefined count of second sections. Each second section comprises a hole. The predefined count of first sections is equivalent to nine first sections. Each first section comprises nine second sections. The base also includes a predefined count of insert members. Each insert member comprises a first portion and a second portion. A plane of the first portion is perpendicular to a longitudinal axis of the second portion. The predefined count of insert members is equal to a total count of second sections in the base. The second portion comprises a protrusion configured to be removably inserted into the hole. The first portion is a square-shaped plate and the second portion is shaped as a cylinder.

These and other features, aspects, and advantages of the present disclosure will become better understood with reference to the following description and appended claims.

BRIEF DESCRIPTION OF THE DRAWINGS

Illustrative embodiments of the present disclosure are described herein with reference to the accompanying drawings, in which.

DETAILED DESCRIPTION

Figure 1:
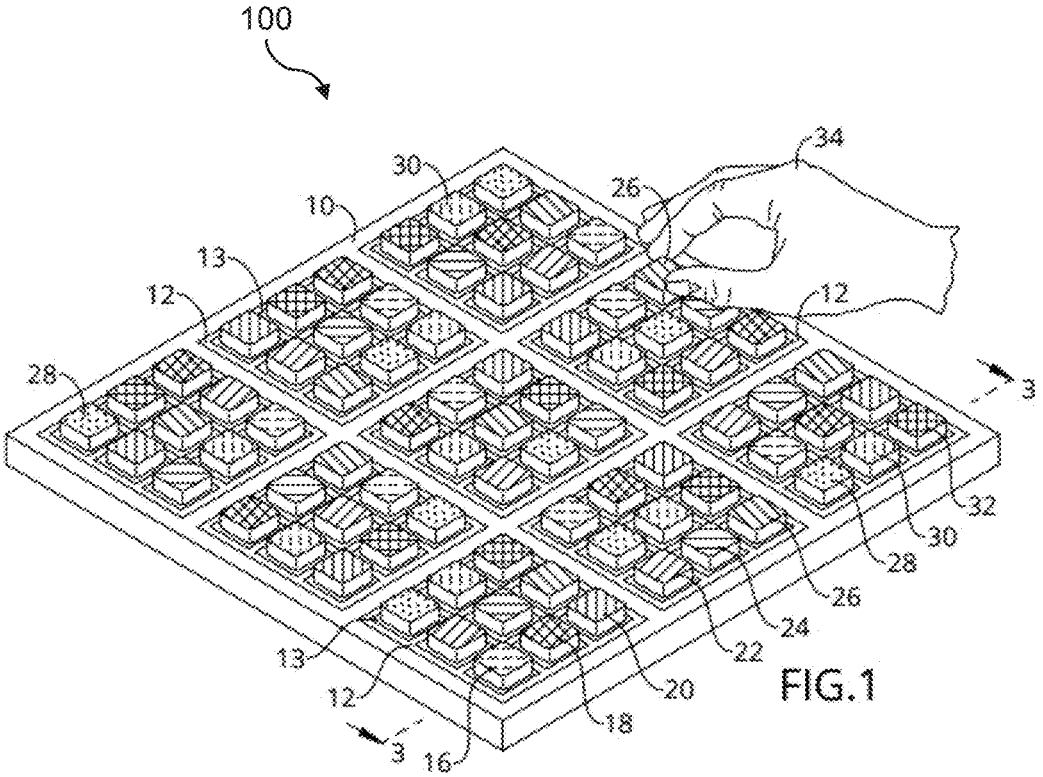
FIG. 1 depicts a perspective view of a board game in accordance with embodiments of the disclosure.

For a further understanding of the nature and function of the embodiments, reference should be made to the following detailed description. Detailed descriptions of the embodiments are provided herein, as well as, the best mode of carrying out and employing the present disclosure. It will be readily appreciated that the embodiments are well adapted to carry out and obtain the ends and features mentioned as well as those inherent herein. It is to be understood, however, that the present disclosure may be embodied in various forms. Therefore, persons of ordinary skill in the art will realize that the following disclosure is illustrative only and not in any way limiting, as the specific details disclosed herein provide a basis for the claims and a representative basis for teaching to employ the present disclosure in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

In accordance with aspects of the disclosure, there is provided a board game that enables visually impaired people to conveniently play the board game. The board game includes a base or a board including a top surface and a bottom surface. In some aspects, the base is square in shape, with a length of each base edge as 22 inches. The board game further includes a predefined count of first sections disposed on the top surface. In some aspects, the board game includes nine first sections, and each first section is square in shape. Further, each first section includes a predefined count of second sections. In some aspects, each first section includes nine second sections. In total, there are 81 second sections in the board game.

In some aspects, each second section is square in shape, with a length of each second section edge as 1.5 inches. In some aspects, each second section includes a hole at a center point of the second section. The board game further includes a predefined count of insert members, and each insert member includes a first portion and a second portion. In some aspects, the predefined count of insert members is equal to a total count of second sections in the base/board, which may be 81.

In some aspects, the first portion of each insert member is a square shaped plate, and the second portion of each insert member is shaped as a cylinder or protrusion. A length of each first portion edge is 2 inches. Further, a plane of the first portion is perpendicular to a longitudinal axis of the second portion. In some aspects, the protrusion or cylinder shaped second portion is configured to be removably inserted into the hole of the second section, to enable removable attachment of the insert member with the second section. In an exemplary aspect, the 81 insert members are made of nine different colors, which may be bright and easily distinguishable from each other.

The present disclosure discloses a board game that may be conveniently played by visually impaired people. The board game includes a big-sized board and big-sized pieces of bright colors that are easy to distinguish, thereby enabling the visually impaired people to conveniently play the board game. Further, the pieces are easy to insert into the board by using protrusion-and-hole attachment arrangement.

Reference will now be made in detail to the present preferred embodiments of the disclosure, examples of which are illustrated in the accompanying drawings. Wherever possible, the same reference numerals are used in the drawings and the description to refer to the same or like parts.

FIG. 1 depicts a perspective view of a board game 100 in accordance with embodiments of the disclosure. FIG. 1 will be described in conjunction with FIGS. 2-5.

Figure 2:
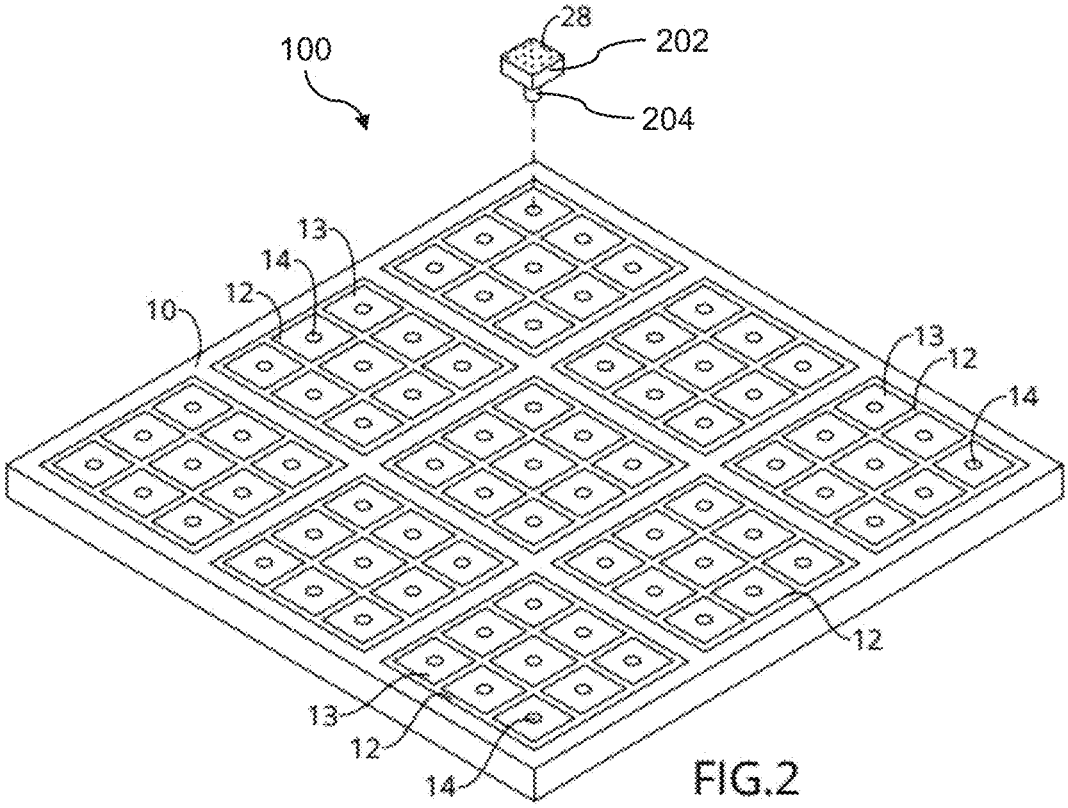
FIG. 2 depicts an exploded view of a board and an insert member of the board game of FIG. 1 in accordance with embodiments of the disclosure.
Figure 3:
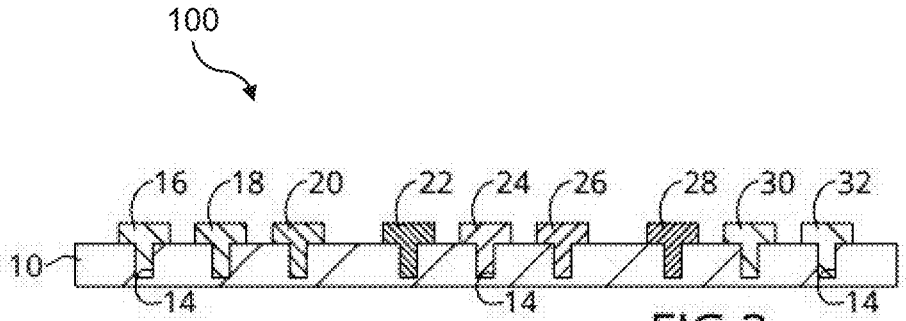
FIG. 3 depicts a section view of the board game taken along 3-3 in FIG. 1 in accordance with embodiments of the disclosure.

The board game 100 is large in size and includes pieces of bright and distinguishable colors that enable people with visual disability (e.g., a user 34) to conveniently play the board game 100. The board game 100 includes a board or a base 10 having a top surface and a bottom surface. The top surface is depicted in FIGS. 1 and 2. In some embodiments, the base 10 may be square in shape, and a length of each base edge may be 22 inches. For example, the dimensions of the base 10 may be 22 inches×22 inches.

The board game 100 further includes a plurality of first sections 12 disposed on the top surface of the base 10. In some embodiments, the board game 100 may include nine first sections 12, and each first section 12 may be square in shape. As depicted in FIGS. 1 and 2, three first sections 12 may be disposed along each edge of the base 10 and one first section 12 may be disposed at a center portion of the base 10, thereby forming a 3×3 grid of first sections 12. In some embodiments, a length of a first section edge may be in a range of 6 to 8 inches, for example, 6.0 inches, and the dimensions of all first sections may be equivalent to each other. While FIGS. 1 and 2 illustrate a 3×3 grid of first sections 12, the base 10 may include a grid of any number of first sections 12, e.g., 4×4.

Each first section 12 may include a plurality of second spaces or second sections 13. In some embodiments, each first section 12 may include nine second sections 13, and each second section 13 may be square in shape. In some embodiments, a length of each second section edge may be 1.5 inches. As depicted in FIG. 2, three second sections 13 may be disposed along each edge of each first section 12 and one second section 13 may be disposed at a center portion of each first section 12, thereby forming a 3×3 grid of second sections 13. Further, each second section 13 may include a hole 14 at a center point of the second section 13, as shown in FIG. 2. While FIGS. 1 and 2 illustrate a 3×3 grid of second sections 13, the first section 12 may include a grid of any number of second sections 13, e.g., 4×4.

The board game 100 may further include a plurality of color pieces or insert members, numbered 16-32 in FIGS. 1-5. In an exemplary aspect, the board game 100 may include a total of 81 insert members. The 81 insert members may be divided into nine different sets of insert members, and each set may include nine similar insert members. In some embodiments, each set of insert members may have insert members of same color, and each set of insert members may be of a different color than the colors of the remaining sets. For example, a first set of nine insert members 16 may be of a first color, a second set of nine insert members 18 may be of a second color, a third set of nine insert members 20 may be of a third color, a fourth set of nine insert members 22 may be of a fourth color, a fifth set of nine insert members 24 may be of a fifth color, a sixth set of nine insert members 26 may be of a sixth color, a seventh set of nine insert members 28 may be of a seventh color, an eighth set of nine insert members 30 may be of an eighth color, and a ninth set nine insert members 32 may be of a ninth color. Each of the first to ninth colors may be bright colors, which are easily distinguishable from each other. For example, the first to ninth colors may be yellow, green, red, black, white, maroon, orange, blue, etc. Further, a total count of insert members in the board game 100 may be equivalent to a total count of second sections 13 in the board game 100.

In some embodiments, each insert member may include a first portion 202 and a second portion 204, as shown in FIG. 2. In some embodiments, the first portion 202 may be a square shaped plate and the second portion 204 may be shaped as protrusion or a cylinder. A length of each first portion edge may be 1.5 inches. Stated another way, the dimensions of the first portion 202 may be 1.5 inch×1.5 inch.

Figure 4:
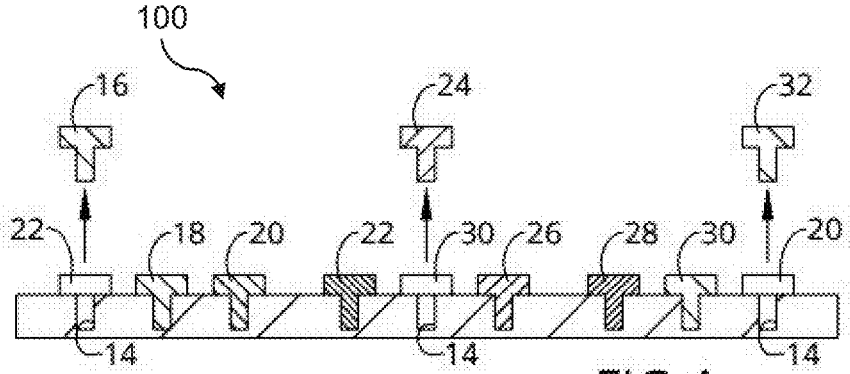
FIG. 4 depicts a section view of the board game showing the removal of insert members in accordance with embodiments of the disclosure.
Figure 5:
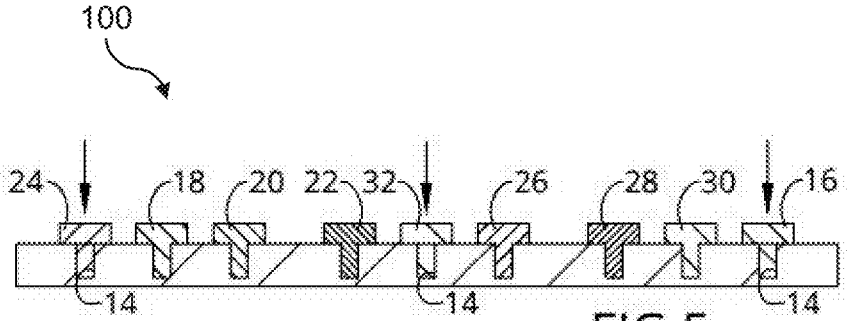
FIG. 5 depicts a section view of the board game showing the insertion/placement of insert members in accordance with embodiments of the disclosure.

In some embodiments, a plane of the first portion 202 is perpendicular to a longitudinal axis of the second portion 204. Further, the second portion 204 may be configured to be removably inserted into the hole 14 of the second section 13, to enable removable attachment of the insert member with the second section 13. An example view of one or more insert members being removed from the holes 14 is shown in FIG. 4, and an example view of one or more insert members being placed or inserted into the holes 14 is shown in FIG. 5.

While playing the board game 100, the user 34 may place the insert members in the second sections 13 such that nine insert members of different colors may be placed in the same first section 12. Since the base 10 and the insert members are large in size, and the insert members are of distinct and distinguishable colors, people with visual disability may conveniently play the board game 100.

To create the board game 100, an operator may cut a board (e.g., the base 10) into a size of 22 inches×24 inches (having, e.g., a thickness of 0.75 inches). The operator may then create/carve out the 9 first sections 12 and 81 second sections 13, as described above and illustrated in FIGS. 1 and 2. The operator may then drill 81 holes in the center points of the 81 second sections 13. The operator may then apply logo, finishing, coating, etc. to the base 10.

The operator may further create 81 "pegs" or insert members. For creating the insert members, the operator may first cut 81 1.5 inches×2 inches square plates (or first portions 202), and drill holes in the center portions of the square plates to a depth that passes through the base 10. The operator may then cut 81 dowels (or second portions 204) to a length that enters the holes, e.g., 0.75 inch length. The operator may then glue each dowel with the hole in each square plate to create 81 insert members. The operator may further paint the insert members with nine colors, as described above.

While various dimensions of the board game 100 have been described above, these dimensions are some examples of possible dimensions of the board game 100. The board game 100 may be constructed having any dimensions that maintain the ability to be conveniently played by visually impaired people.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This disclosure is susceptible to considerable variation within the spirit and scope of the appended claims.

The claimed disclosure is:

1. A board game for low-vision users comprising:

a base comprising a top surface and a bottom surface;

a predefined count of first sections disposed on the top surface, wherein:

each first section comprises a predefined count of second sections, and each second section comprises a hole; and a predefined count of insert members, wherein each insert member comprises a first portion and a second portion, and wherein:

a plane of the first portion is perpendicular to a longitudinal axis of the second portion, wherein each of the predefined count of insert members has a coating and each said coating has a layer of paint on the coating to that each insert member is entirely made of one of nine different colors, respectively, wherein each color of the nine different colors is a distinct color configured for the low-vision users to distinguish, upon visual inspection, from the remaining eight of the nine different colors;

the predefined count of insert members is equal to a total count of second sections in the base, and the second portion comprises a protrusion configured to be removably inserted into the hole.

2. The board game of claim 1, wherein the top surface of the base is at least 22 by 22 inches so as to afford the low-vision user manual access to each of the first portions during insertion into and removal from said top surface.

3. The board game of claim 1, wherein the predefined count of first sections is equivalent to nine first sections.

4. The board game of claim 1, wherein each first portion is a cuboid having opposed 1.5 by 1.5-inch square faces wherein the second portion is centrally disposed in one of the 1.5 by 1.5-inch square faces, wherein said central disposition enables the low-vision user to tactilely discern an insertion position of each insert member.

5. The board game of claim 1, wherein each first section comprises nine second sections.

6. The board game of claim 1, wherein each second section is square in shape.

7. The board game of claim 1, wherein the predefined count of insert members is equivalent to 81 insert members.

8. The board game of claim 1, wherein the first portion is a square shaped plate and the second portion is shaped as a cylinder.

9. The board game of claim 1, wherein each first section is perimetrically defined by a recessed groove circumscribing an entirety of a perimeter of the first section, whereby the recessed groove enables the low-vision user to tactilely discern a relative location of each first section.

10. A board game comprising:

a base comprising a top surface and a bottom surface;

a predefined count of first sections disposed on the top surface, wherein:

each first section comprises a predefined count of second sections, each second section comprises a hole, the predefined count of first sections is equivalent to nine first sections, and each first section comprises nine second sections; and a predefined count of insert members, wherein each insert member comprises a first portion and a second portion, and wherein:

each of the predefined count of insert members has a coating and each said coating has a layer of paint on the coating, and each layer of paint is entirely made of one of nine different colors, wherein each color of the nine different colors is a distinct color configured for the low-vision users to distinguish from the remaining eight of the nine different colors upon visual inspection;

a plane of the first portion is perpendicular to a longitudinal axis of the second portion, the predefined count of insert members is equal to a total count of second sections in the base, the second portion comprises a protrusion configured to be removably inserted into the hole, and the first portion is a cuboid having opposed 1.5 by 1.5-inch square faces and the second portion is shaped as a cylinder;

wherein the top surface of the base is at least 22 by 22 inches so as to afford a low-vision user manual access to each of the first portions during insertion of each insert member into and removal from said top surface the base;

wherein the second portion is centrally disposed in one of the 1.5 by 1.5-inch square faces, whereby said centrally disposition enables the low-vision user to tactilely discern an insertion position of each insert member; and wherein each first section is perimetrically defined by a recessed groove circumscribing an entirety of a perimeter of the first section, whereby the recessed groove enables the low-vision user to tactilely discern a relative location of each first section.

* * * * *